US006654026B2

(12) United States Patent
Lee

(10) Patent No.: US 6,654,026 B2
(45) Date of Patent: Nov. 25, 2003

(54) APPARATUS FOR PROCESSING IMAGE SIGNALS IN A MONITOR SYSTEM

(75) Inventor: Jae Min Lee, Taequ-shi (KR)

(73) Assignee: LG Electronics Inc., Seoul (KR)

( * ) Notice: Subject to any disclaimer, the term of this patent is extended or adjusted under 35 U.S.C. 154(b) by 259 days.

(21) Appl. No.: 09/925,701

(22) Filed: Aug. 10, 2001

(65) Prior Publication Data

US 2002/0021273 A1 Feb. 21, 2002

(30) Foreign Application Priority Data

Aug. 10, 2000 (KR) ..... 2000-46337

(51) Int. Cl.[7] ..... G09G 5/02

(52) U.S. Cl. ..... 345/600; 345/601; 345/605; 345/660; 345/592; 345/598; 345/3.4

(58) Field of Search ..... 345/600, 601, 345/605, 660, 592, 589, 3.4

(56) References Cited

U.S. PATENT DOCUMENTS 5,227,863 A * 7/1993 Bilbrey et al. ..... 348/578
5,557,297 A * 9/1996 Sharp et al. ..... 345/614
5,668,890 A * 9/1997 Winkelman ..... 382/167
5,896,140 A * 4/1999 O'Sullivan ..... 345/536
6,069,607 A * 5/2000 Everett et al. ..... 345/660
6,097,352 A * 8/2000 Zavracky et al. ..... 345/7
6,208,467 B1 * 3/2001 Naka et al. ..... 359/618
6,320,529 B1 * 11/2001 Yasuda ..... 341/155
6,366,292 B1 * 4/2002 Allen ..... 345/611
6,426,780 B1 * 7/2002 Limberg et al. ..... 348/725

* cited by examiner

*Primary Examiner*—Matthew C. Bella
*Assistant Examiner*—Manucher Rahmjoo
(74) *Attorney, Agent, or Firm*—Jacobson Holman PLLC

(57) ABSTRACT

An apparatus for processing image signals in a monitor system having an LCD module is enclosed. The apparatus includes an A/D converter converting analog R/G/B input image signals received into first 8-bit digital R/G/B image signals; a microprocessor determining whether a resolution of the input image signals is supported by the LCD module and generating a corresponding control signal, the resolution being determined using a horizontal/vertical sync signal received; an image converter converting the first 8-bit digital R/G/B image signals into second 8-bit digital R/G/B image signals based on the control signal if the resolution of the input signals is not supported by the LCD module, the second 8-bit digital R/G/B image signals being displayable on the LCD module; a scaler adjusting frame sizes of the first or second 8-bit digital R/G/B image signals; and a switch outputting the first 8-bit digital R/G/B image signals to the scaler or the image converter depending on the control signal. By using the apparatus according to the present invention, input images can still be properly displayed on the LCD module even if its resolution is not supported by the display module. In such case, the images signals are processed in the image converter in order to generate displayable image signals. On the other hand, if the display module supports the resolution of the input images, they directly get displayed on the LCD module without going through the image converter.

14 Claims, 3 Drawing Sheets

APPARATUS FOR PROCESSING IMAGE SIGNALS IN A MONITOR SYSTEM

BACKGROUND OF THE INVENTION

1. Field of the Invention

The present invention relates to a monitor, and more particularly, to an apparatus for processing image signals in a monitor system having an LCD module.

2. Background of the Related Art

In general, a monitor is a device for displaying image signals received from a PC video card after performing appropriate signal processes such as digital sampling and/or scaling on the image signals. The monitor technology has started from a small CRT (Cathode Ray Tube) monitor, and now a digital displaying technique using an LCD, which is a representative flat display device being adequate for a large monitor, is widely being used. Additionally, the quality of a monitor is often expressed as its resolution rate: i.e., SVGA (800 by 600), XGA (1280 by 768), and SXGA (1280 by 1024).

Reference will now be made in detail to a related art monitor system. FIG. 1 illustrates a typical monitor system according to the related art. According to FIG. 1, the monitor system includes a microprocessor 1 for determining an image mode based on a horizontal and vertical sync signal received and for generating a corresponding control signal to perform appropriate signal processes based on the determined image mode; and a PLL (Phase Locked Loop) 2 for generating a clock pulse based on the control signal generated in the microprocessor 1.

The apparatus further includes an A/D converter 3 for converting the analog R/G/B input image signal into digital signal by sampling based on the clock pulse generated in the PLL 2; a scaler 4 for adjusting the frame sizes of the digital R/G/B image signal based on the control signal of the microprocessor using the clock pulse generated in the PLL 2; a frame buffer 5 memory for storing the output from the scaler 4; an LCD module 7 for displaying the output from the scaler 4; and an OSD generator 6 for generating a corresponding OSD message according to the control signal of the microprocessor 1 when the resolution rate is not in the allowed range set by the LCD module 7.

The procedural steps explaining how the monitor system shown in FIG. 1 works are as follows. First of all, when the analog R/G/B input image signal and the horizontal/vertical sync signals are inputted from the Video card to the A/D converter 3 and to the microprocessor 1, the microprocessor 1 determines the resolution rate (SVGA/XGA/SXVGA) of the inputted image signal using the horizontal/vertical sync signal. Subsequently, the microprocessor 1 provides a corresponding control signal to the PLL 2 for setting up a sampling clock of the A/D converter 3 in order to have a digital conversion corresponding to a desired resolution rate set by a user if the resolution rate of the input image signal is less than or equal to the rate supported by the monitor (For example, the monitor is XGA, and the input signal is XGA or SVGA).

Therefore, the A/D converter 3 simultaneously outputs an 8-bit R/G/B image signal and a dot clock for signal recognition of the scaler 4 by performing an appropriate digital sampling process for which a 95 MHz-sampling clock matching to the horizontal sync signal is generated according to the control signal of the microprocessor 1.

Thereafter, in accordance with the control signal, the scaler 4 stores the output of the A/D converter 3 in the frame buffer memory 5 in frame units being adequate for the XGA resolution rate and outputs it to the LCD module 7 afterward Thereafter, the LCD module 7 reads the 8-bits digital image data generated from the scaler 4 in accordance to the data enable (D/E) signal and the outside clock (OUT CLK) and display them in accordance to the horizontal/vertical sync signal.

On the other hand, in a case where the resolution of the monitor and the input image signal are XGA and SXGA, respectively, a 135 MHz sampling clock must be provided to converts the SXGA input image to digital data. However, since the maximum sampling clock the XGA monitor can support is 100 MHz, it will not be able to display the image data. Instead, the OSD generator 6 will generate an OSD message "Out of Range" and display the OSD message on the LCD module 7.

The problems of the monitor based on the prior art technology due to its limitations and disadvantages are as follows. First, in a case where the resolution set in a CRT monitor is not supported by an LCD monitor when it is desired to use the LCD monitor instead of the CRT monitor, the image data will not be able to be displayed properly on the LCD monitor. It will simply display an OSD message "Out of Range" on the screen of the LCD monitor. Second, in order to display the image data on the LCD monitor, the user must reconnect to the original CRT monitor, change the resolution of the image data so that the LCD monitor can support it, and connect to the LCD monitor. This will give a significant inconvenience to a user. Third, the user sometimes will regard this problem as a defect of the LCD monitor and will request to the service center for a repair.

SUMMARY OF THE INVENTION

Accordingly, the present invention is directed to an apparatus for processing input image signals in a monitor system having an LCD module that substantially obviates one or more problems due to limitations and disadvantages of the related art.

An object of the present invention is to provide an apparatus for processing the input image signals in a display system in order to view input images on the display system even when the monitor (LCD) system-does not support the resolution of the input images.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for processing image signals in a monitor system having an LCD module includes an A/D converter converting analog R/G/B input image signals received into first 8-bit digital R/G/B image signals; and a microprocessor determining whether a resolution of the input image signals is supported by the LCD module and generating a corresponding control signal, the resolution being determined based on a horizontal/vertical sync signal received.

It further includes an image converter converting the first 8-bit digital R/G/B image signals into second 8-bit digital R/G/B image signals based on the control signal if the resolution of the input signals is not supported by the LCD module, the second 8-bit digital R/G/B image signals being displayable on the LCD module; a scaler adjusting frame sizes of the first or second 8-bit digital R/G/B image signals; and a switch outputting the first 8-bit digital R/G/B image signals to the scaler or the image converter depending on the control signal.

The image converter included in the apparatus described above includes a first sub-converter separately compressing the first 8-bit digital R/G/B image signals into Nbit digital R/G/B image signals, N being less than 8; a mixer mixing the N-bit digital R/G/B image signals to generate a N-bit mixed signal; a storage storing the N-bit mixed signal; and a second sub-converter extracting the stored N-bit mixed signal into the second 8-bit digital R/G/B image signals according to the control signal and separately outputting the second 8-bit digital R/G/B image signals to the scaler.

In another aspect of the present invention, an apparatus for processing image signals in a monitor system having an LCD module includes an A/D converter converting analog R/G/B input image signals received into first 8-bit digital R/G/B image signals; and a microprocessor determining whether a resolution of the input image signals is supported by the LCD module and generating a corresponding control signal, the resolution being determined using a horizontal/vertical sync signal received.

It further includes an image converter converting one of the first 8-bit digital R/G/B image signals into a second 8-bit digital image signal based on the control signal if the resolution of the input signals is not supported by the LCD module, the second 8-bit digital image signal being displayable on the LCD module; a scaler adjusting frame sizes of the first 8-bit digital R/G/B image signals or the second 8-bit digital image signal; and a switch outputting the one of the first 8-bit digital R/G/B image signals to the image converter or outputting all of the first 8-bit digital R/G/B image signals to scaler depending on the control signal.

Similarly, the image converter includes a first subconverter compressing the one of the first 8-bit digital R/G/B image signals into a N-bit digital image signal, where N is less then 8; a storage storing the n bit digital image signal; and a second sub-converter extracting the stored n bit digital image signal to generate the second 8-bit digital image signal based on the control signal and outputting the second 8-bit digital image signal to the scaler.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
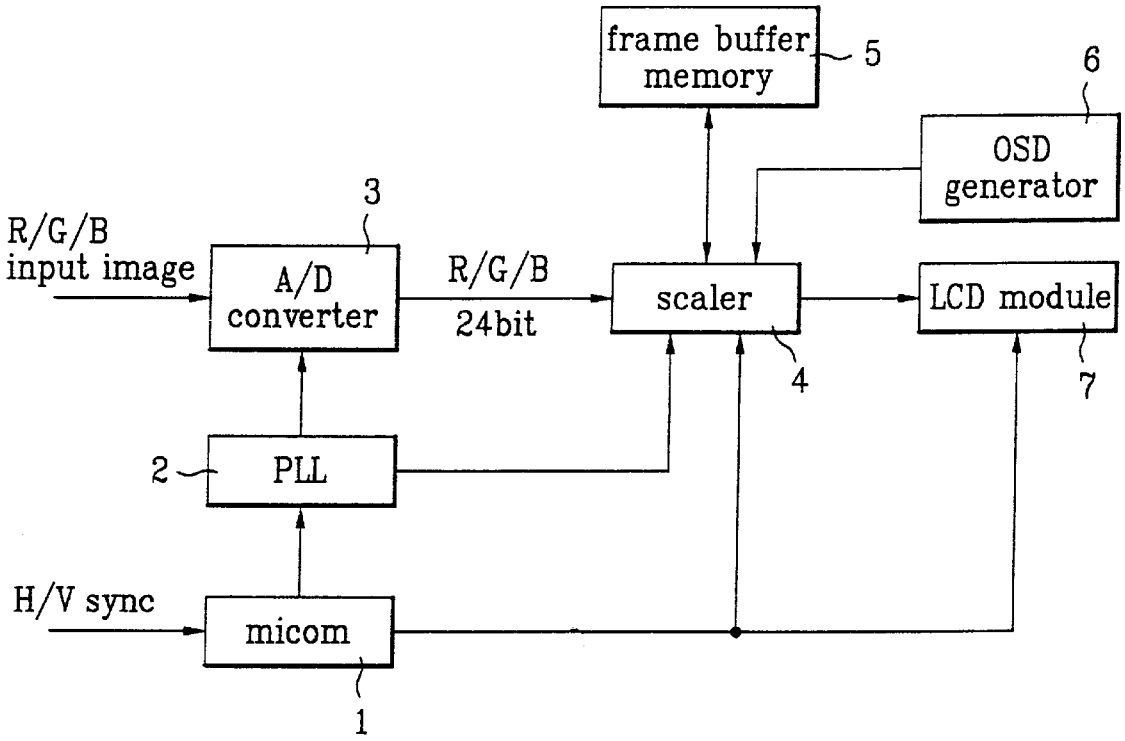
FIG. 1 Related Art
FIG. 1 is a block diagram illustrating a typical monitor system according to the related art.
Figure 2:
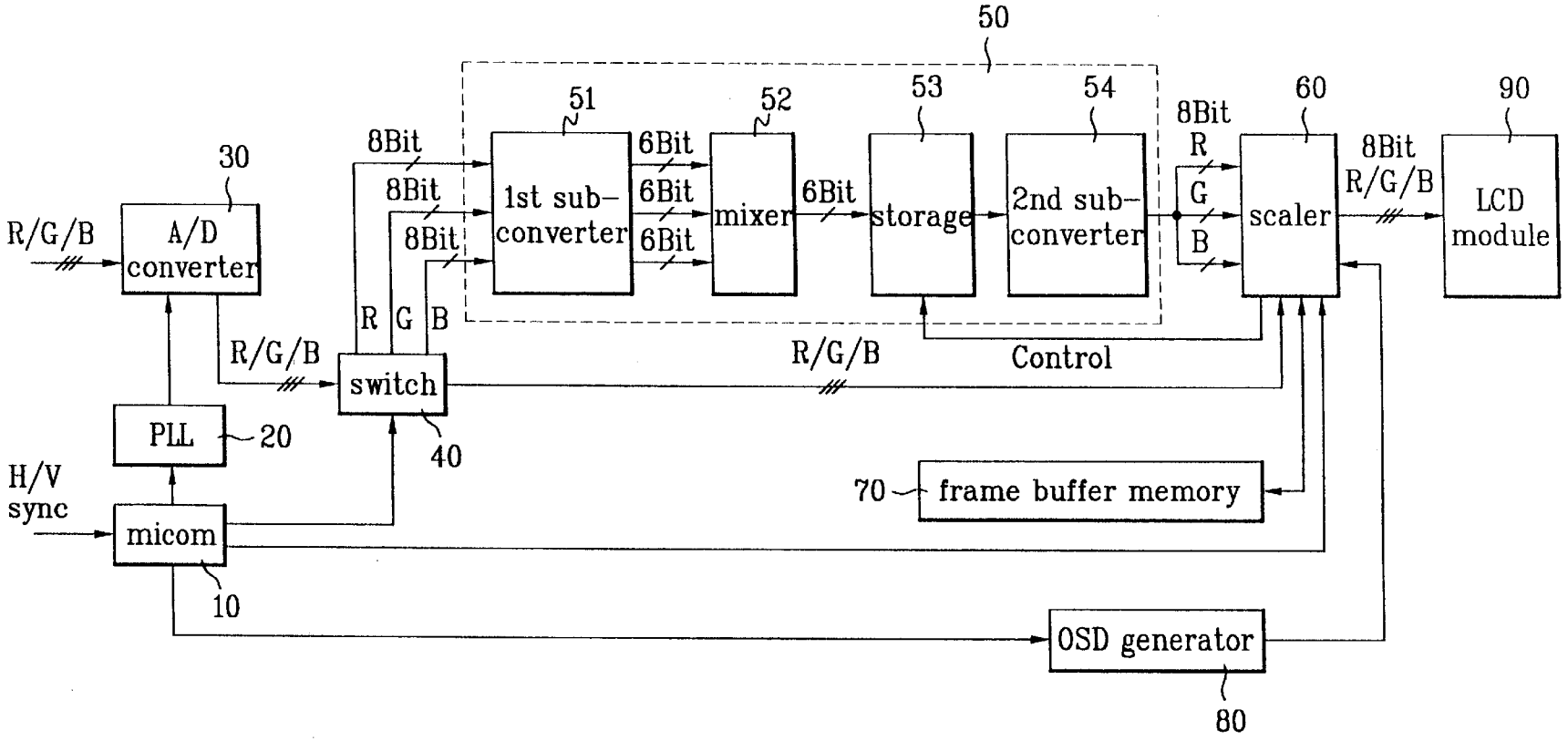
FIG. 2 is a block diagram illustrating an apparatus for processing input image signals in a monitor system according to the present invention.
Figure 3:
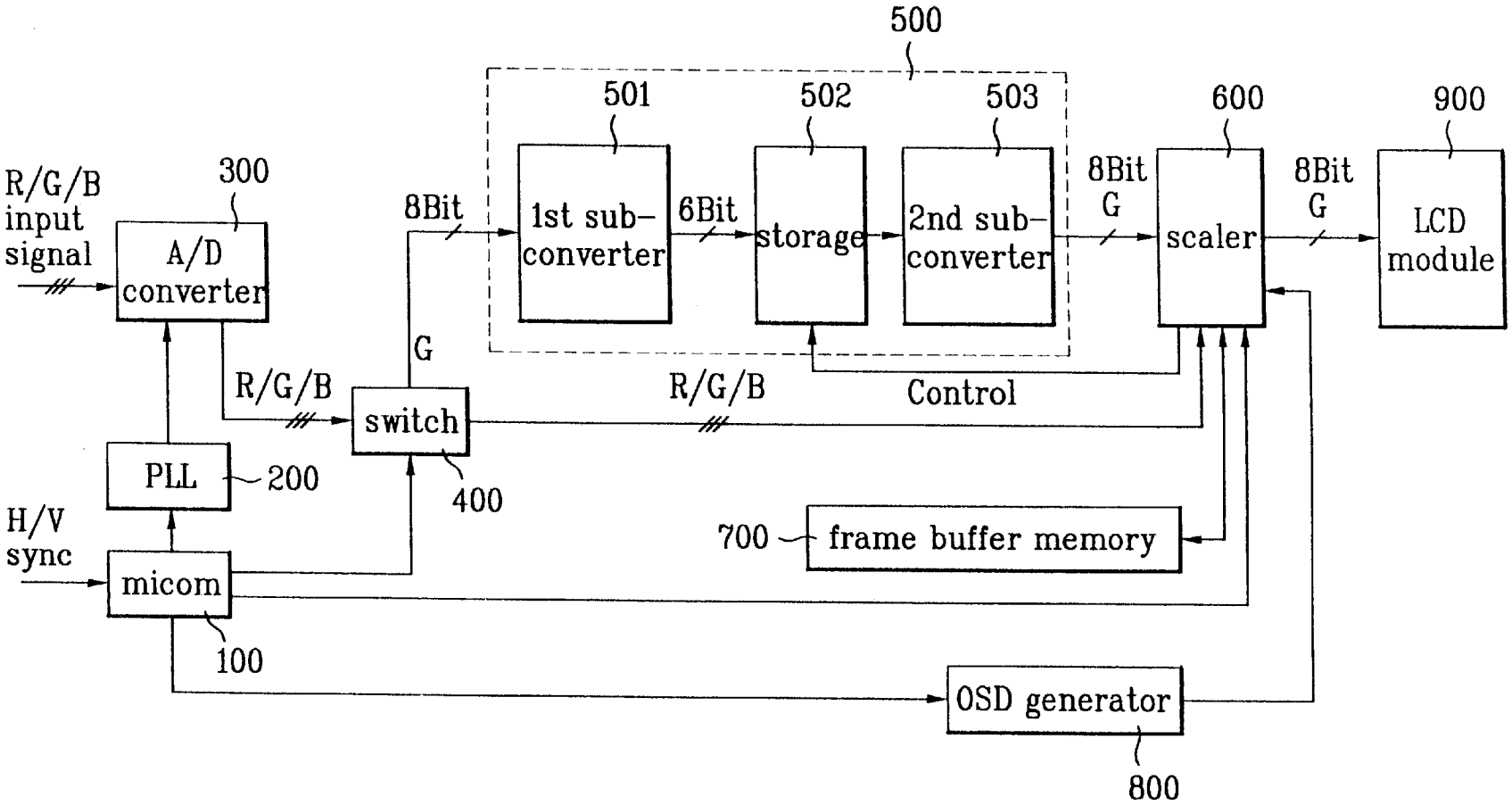
FIG. 3 is a block diagram illustrating a corresponding embodiment of an apparatus for processing input image signals in a monitor system according to the present invention

FIG. 2 is a block diagram illustrating an apparatus for processing input image signals in a monitor system including an LCD module according to the present invention, and FIG. 3 illustrates a corresponding embodiment of the present invention.

As shown in FIG. 2, the apparatus for processing the input image signals in a monitor system according to the present invention includes a microprocessor 10 for determining the image mode of the input image data based on the frequencies of the horizontal and vertical sync signal received and for generating an appropriate control signal so that the image data can be appropriately processed according to the image mode determined; a PLL (Phase Locked Loop) 20 for generating a clock pulse corresponding to the control signal of the microprocessor 10; and an A/D converter 30 for converting the analog R/G/B input image signals into digital R/G/B signals by sampling the input signals according to the clock pulse provided by the PLL 20.

It further includes an image converter 50 for converting the 8-bits digital R/G/B image signals generated from the A/D converter 30 into displayable image signals by compressing and further processing the signals according to the control signal if the resolution rate of the input image data is not supported by the LCD module; a scaler 60 for receiving the digital R/G/B image signal generated from the image converter 50 or the A/D converter 30 and adjusting their frame sizes for a proper display; a switch 40 for determining whether to process the signals in the scaler 60 or the image converter 50 according to the control signal of the microprocessor 10; an OSD generator 80 for generating an OSD message in accordance with the control signal; and an LCD module 90 for displaying the image data selected in accordance with the switching signal of the switch 40

The image converter 50 includes a first sub-converter 51 converting the digital 8-bit R/G/B signals generated from the A/D converter 30 into N-bit R/G/B signals, where N being less than 8; a mixer 52 mixing the N-bit digital signals; a storage 53 storing the mixed signal; and a second sub converter 54 converting the stored signal to digital 8-bit R/G/B image signals.

First, the microprocessor 10 determines the type of the image mode based on the frequency of the horizontal/vertical sync signal received and generates a corresponding control signal to the PLL 20 in order to provide a corresponding sampling clock to the A/D converter 30 and to the scaler 60. Also, the microprocessor 10 checks whether the resolution of the input image signals determined from the sync signal can be supported by the LCD module 90 and generates a corresponding control signal to the switch 40.

The switch 40 then transmits the digital R/G/B image signals to the image converter 50 or scaler 60 depending on the control signal generated from the microprocessor 10. In other words, if the microprocessor 10 determines that the resolution of the image is not supported by the LCD module 70, the switch 40 outputs the digital R/G/B image signals to the image converter 50 to convert them to displayable image signals so that they can be properly displayed on the LCD module 70.

The first sub converter converts the 8-bit digital signals received from the switch 40 into N-bit digital signals by compressing, where N being less than 8. Thereafter, the compressed N-bit digital image signals are mixed in the mixer 52 and the mixed signal is stored in the storage 53. The mixed signal stored in the storage 53 are then inputted to the second sub converter 54 according to the control signal of the scaler 60 in order to be converted to 8-bit digital signals. Finally, the converted signals are divided to each of R/G/B signals to be displayed on the LCD module 70. Additionally, if microprocessor 10 determines that the resolution of the input image can be supported by the LCD module, the switch 40 outputs the image signals directly to the scaler 60 without going through the image converter. The scaler 60 then adjusts the frame sizes of the image signals and stores the size adjusted image frames in the frame buffer memory. Finally, the LCD module displays the stored image frames.

First Embodiment

A first embodiment of the present invention will now be-explained in detail as follows. FIG. 3 is a block diagram illustrating a corresponding embodiment of the apparatus for processing input image signals in a monitor system having an LCD module according to the present invention. The apparatus includes a microprocessor 100 for determining an image mode of the input images based on the frequencies of a horizontal and vertical sync signal received and for generating a corresponding control signal in order to perform proper signal processes based on the image mode determined; a PLL (Phase Locked Loop) 200 for generating a clock pulse according to the control signal received from the microprocessor 100; and an A/D converter 300 for converting the analog R/G/B input image signals into digital R/G/B image signals.

It further includes an image converter 500 for receiving only one of the digital R/G/B signals converted by the A/D converter 300 according to the control signal of the microprocessor 100 and for converting the received digital signal into a displayable image signal through a given set of signal processes if the resolution of the input image is not supported by an LCD module 900; a scaler 600 for performing an appropriate process to convert the digital G image signal generated from the image converter 500 or the digital R/G/B image signals converted from the A/D converter 300 into displayable signals; a switch 400 for sending the signals to one of the scaler 600 and an image converter 500 depending on the control signal of the microprocessor 100; an OSD generator 800 for generating an OSD message according to the control signal of the microprocessor 100; and an LCD module 900 for displaying the output signal being selected by the switch 400 according to a switching signal.

The image converter 500 includes a first sub-converter 501 for converting one of 8-bit digital R/G/B image signals provided from the A/D converter 300 according to the switching signal into a N-bit digital image, N being less than 8; a storage 502 for storing the N-bit digital image signal received from the first sub-converter 501; and a second sub-converter for generating a 8-bit digital image signal by decompressing the compressed image signal stored in the storage and outputting the 8-bit digital image signal to the scaler 600.

First, the microprocessor 100 determines the type of the image based on the frequency of the horizontal/vertical sync signal received and generates a corresponding control signal to the switch 400 in order to drive the image converter 500 if the LCD module 900 does not support the resolution of the input image received. The resolution information is available upon determination of the type of the input image.

Once it is determined to drive the image converter 500, the image converter 500 then receives only one of the 8-bit digital R/G/B signals for displaying in a single color. For example, the first sub-converter 501 of the image converter 500 compresses the 8-bit G signal by converting to a 6-bit G signal, and the compressed signal (6-bit) gets stored in the storage 502. The compressed signal stored in the storage 502 then is output to the second sub-converter 503 according to the control signal of the scaler 600 and is converted to a 8-bit digital G image signal which is now displayable on the LCD module 900.

Thereafter, the signal passes through the scaler 600 and gets displayed on the LCD module 900. The forgoing example is merely exemplary and is not to be construed as limiting the type of the signal that should be converted in the image converter 500. Although only a G signal is selected as an example of format conversion, any one of the digital R/G/B image signals can be processed in the image converter 500 using an identical technique.

In conclusion, the apparatus for processing the image signals in a monitor system enables the monitor to be able to properly display the output images even if the display device does not support the resolution of the input images. Therefore, customers are able to view the images through the monitor regardless of the type (resolution) of the input image the monitor receives.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An apparatus for processing image signals in a monitor system having an LCD module, the apparatus comprising:

an A/D converter converting analog R/G/B input image signals received into first 8-bit digital R/G/B image signals;

a microprocessor determining whether a resolution of said input image signals is supported by said LCD module and generating a corresponding control signal, said resolution being determined based on a horizontal/vertical sync signal received;

an image converter converting said first 8-bit digital R/G/B image signals into second 8-bit digital R/G/B image signals based on said control signal if said resolution of said input signals is not supported by said LCD module, said second 8-bit digital R/G/B image signals being displayable on said LCD module;

a scaler adjusting frame sizes of said first or second 8-bit digital R/G/B image signals; and a switch outputting said first 8-bit digital R/G/B image signals to said scaler or said image converter depending on said control signal.

2. The apparatus of claim 1, wherein said image converter comprising:

a first sub-converter separately compressing said first 8-bit digital R/G/B image signals into N-bit digital R/G/B image signals, where N being less than 8;

a mixer mixing said N-bit digital R/G/B image signals to generate an N-bit mixed signal;

a storage storing said N-bit mixed signal; and a second sub-converter extracting said stored N-bit mixed signal into said second 8-bit digital R/G/B image signals according to said control signal and outputting said second 8-bit digital R/G/B image signals to said scaler.

3. The apparatus of claim 2, wherein said first subconverter performs a ¾ rate compression process on said first 8-bit digital R/G/B image signals.

4. The apparatus of claim 2, wherein said N-bit digital R/G/B image signals are 6-bit digital R/G/B image signals.

5. The apparatus of claim 2, wherein said N-bit mixed signal includes each of said N-bit digital R/G/B image signals.

6. The apparatus of claim 4, wherein said N-bit mixed signal is a black and white signal.

7. The apparatus of claim 2, wherein said mixer further compresses said N-bit digital R/G/B signals with a ⅓ rate.

8. The apparatus of claim 1, wherein said second 8-bit digital R/G-/B image signals converted by said image converter are inputted to said scaler.

9. The apparatus of claim 1 further comprising a phase locked loop (PLL) generating a clock pulse based on said control signal and providing said clock pulse to said A/D converter.

10. An apparatus for processing image signals in a monitor system having an LCD module, the apparatus comprising:

an A/D converter converting analog R/G/B input image signals received into first 8-bit digital R/G/B image signals;

a microprocessor determining whether a resolution of said input image signals is supported by said LCD module and generating a corresponding control signal, said resolution being determined based on a horizontal/vertical sync signal received;

an image converter converting one of said first 8-bit digital R/G/B image signals into a second 8-bit digital image signal based on said control signal if said resolution of said input signals is not supported by said LCD module, said second 8-bit digital image signal being displayable on said LCD module;

a scaler adjusting frame sizes of said first 8-bit digital R/G/B image signals or said second 8-bit digital image signal; and a switch outputting said one of said first 8-bit digital R/G/B image signals to said image converter or outputting all of said first 8-bit digital R/G/B image signals to scaler depending on said control signal.

11. The apparatus of claim 10, wherein said image converter comprising:

a first sub-converter compressing said one of said first 8-bit digital R/G/B image signals into an N-bit digital image signal, where N being less than 8;

a storage storing said N-bit digital image signal; and a second sub-converter extracting said stored N-bit digital image signal to generate said second 8-bit digital image signal based on said control signal and outputting said second 8-bit digital image signal to said scaler.

12. The apparatus of claim 11, wherein said N-bit digital image signal is a 6-bit digital image signal.

13. The apparatus of claim 10, wherein said second 8-bit digital image signal is inputted to said scaler.

14. The apparatus of claim 10 further comprising a phase locked loop (PLL) generating a clock pulse based on said control signal and providing said clock pulse to said A/D converter.

* * * * *